United States Patent [19]

Kircher

[11] 4,381,984

[45] May 3, 1983

[54] ELECTRODE FRAME

[75] Inventor: Morton S. Kircher, Clearwater, Fla.

[73] Assignee: Olin Corporation, New Haven, Conn.

[21] Appl. No.: 250,506

[22] Filed: Apr. 2, 1981

Related U.S. Application Data

[63] Continuation-in-part of Ser. No. 157,918, Jun. 6, 1980, Pat. No. 4,313,812, which is a continuation-in-part of Ser. No. 128,684, Mar. 10, 1980, abandoned, and Ser. No. 143,969, Apr. 25, 1980, Pat. No. 4,312,737.

[51] Int. Cl.[3] ..... C25B 9/00; C25B 15/08; C25B 11/03

[52] U.S. Cl. ..... 204/258; 204/279; 204/284; 204/288; 204/289

[58] Field of Search ..... 204/279, 253–258, 204/284, 288–289; 52/656, 815, 732, 806, 821

[56] References Cited

U.S. PATENT DOCUMENTS

| | | | |
|---|---|---|---|
| 1,721,407 | 7/1929 | Pechkranz | 204/254 |
| 2,759,574 | 8/1956 | Miller | 52/826 X |
| 2,827,670 | 3/1958 | Schwindt | 52/826 X |
| 3,477,186 | 11/1969 | Birum, Jr. | 52/732 X |
| 3,604,174 | 9/1971 | Nelson, Jr. | 52/656 X |
| 3,980,545 | 9/1976 | de Lachaux et al. | 204/286 |
| 4,069,129 | 2/1978 | Sato et al. | 204/258 |
| 4,111,779 | 9/1978 | Seko et al. | 204/255 |
| 4,174,911 | 11/1979 | Maccario et al. | 52/732 X |
| 4,175,025 | 11/1979 | Creamer et al. | 204/253 |
| 4,210,516 | 7/1980 | Mose et al. | 204/284 |
| 4,218,293 | 8/1980 | Nawrot | 204/95 |
| 4,268,372 | 5/1981 | Iizima et al. | 204/252 |

*Primary Examiner*—Donald R. Valentine
*Attorney, Agent, or Firm*—Ralph D'Alessandro; Donald F. Clements; Thomas P. O'Day

[57] ABSTRACT

In a filter press membrane electrolytic cell there is provided a reinforced electrode frame channel that is backed by a reinforcing strip which also serves as a gasket restraint when the adjacent electrodes are compressed to form the assembled cell.

18 Claims, 6 Drawing Figures

ELECTRODE FRAME

BACKGROUND OF THE INVENTION

This application is a continuation-in-part of application Ser. No. 157,918 now U.S. Pat. No. 4,313,812, filed June 6, 1980, entitled "MEMBRANE ELECTRODE PACK CELLS DESIGNED FOR MEDIUM PRESSURE OPERATION" which is a continuation-in-part of U.S. Ser. No. 128,684, filed Mar. 10, 1980, abandoned, entitled "MEMBRANE-ELECTRODE PACK ALKALI CHLORINE CELL" and U.S. application Ser. No. 143,969, now U.S. Pat. No. 4,312,737, filed Apr. 25, 1980, entitled "ELECTRODE FOR MONOPOLAR FILTER PRESS CELLS".

The present invention relates to electrode frames suitable for use in a filter press-type electrolytic cell. More particularly, the invention relates to the reinforcing strip fastened to the frame channel utilized to strengthen the individual electrode frame as well as to restrain the sealing gasket which is placed between the adjacent electrode frames and the ion-selectively permeable membrane in an electrolytic cell.

Commercial cells for the production of chlorine and alkali metal hydroxides have been continually developed and improved over a period of time dating back to at least 1892. In general, chlor-alkali cells are of the deposited asbestos diaphragm type or the flowing mercury cathode type. During the past few years, developments have been made in cells employing separators having ion exchange properties which promise advantages over either diaphragm or mercury cells. It is desirable to take advantage of existing technology, particularly in diaphragm cells, but it is also necessary to provide cell designs which meet the requirements of these newer separator materials. Since suitable separator materials, such as those marketed by E. I. Du Pont de Nemours and Company under the trademark "Nafion®" and by Asahi Glass Company Ltd. under the trademark "Flemion®", are available primarily in sheet form, the most generally used cell employing such separators are of the "filter press" type. Filter press cells may employ electrode structures which are monopolar or bipolar.

In the filter press cell, separators in sheet form, usually ion-selectively permeable membranes substantially impervious to hydraulic flow, are clamped between the sides of frame members. The sealing means employed, normally elastomeric gaskets, must effectively provide a fluid-tight seal between the frame members and the membranes without damaging the membranes. Part of the difficulty in obtaining a fluid-tight seal has been found to reside in the fact that the gaskets utilized to separate the electrode frame members are available with thicknesses that widely vary because of large manufacturing tolerances.

It has been found in the assembly of filter press membrane cells that this difference in thickness between the gaskets employed on adjacent electrode frames can present problems when attempting to compress the frames into a fluid-tight cell. Frequently, hydraulic rams or other types of pressure-applying apparatus are employed to compress the electrode frames and the separating gaskets together. Where there are differences in the thickness of the gaskets, it has been found that each gasket is not subjected to an equal level of compression. The thicker gaskets are naturally subjected to greater compression than thinner gaskets. Where the difference in thickness is too great, a predetermined compression force applied to a cell and its component electrode frames can leave spaces between the thinner gaskets and adjacent frames so that fluid leakage will occur. To correct this, additional pressure must be applied to the electrode frames to achieve a level of compression in the separating gaskets that will form a fluid-tight seal. Frequently, during this additional compression-applying step, excessive force can be applied which causes the frames to deform or bend. Additionally, if the surfaces of the electrode frames are not completely flat or are rounded, it has been found that the gaskets will pop out from between the electrode frames because of the contour of the frames and the pressure being applied to the gaskets. This situation has necessitated that frames be individually assembled and carefully aligned to prevent leakage. To correct, for example, a 0.010 of an inch spacing gap between a gasket and an adjacent frame that is causing fluid leakage, it has been found necessary to tighten all of the gaskets 0.010 of an inch to stop the leak.

The electrode frame material in filter press cells is generally of thick, solid construction since the individual electrode frames are under considerable compressive force when assembled. The individual electrode frames are subject to even greater compressive force when the filter press cell is operated under a pressure greater than atmospheric pressure.

Cell construction which has been used or proposed for filter press cells, especially for use in cells designed to be operated above atmospheric pressure, has required heavy member construction and/or cylindrical shape. Heavy walled construction in the electrode frames either with solid wall resistant metals such as titanium and nickel, or with steel that is lined with resistant metal, tends to be very expensive and consumes large amounts of metal. Additionally, in designing electrodes for filter press cells, it is economically and functionally advantageous to employ large planar surfaces for the membranes and the electrode mesh, both of which are also extraordinarily expensive materials.

For these reasons, filter press membrane chloralkali cells have not been developed commercially heretofore beyond a minor fraction of the total North American chlor-alkali production. Construction, based on circular electrodes within a cylindrical container with dished heads, has been proposed as a means of meeting pressure means more economically. However, since major items, such as the aforementioned electrode materials are inherently produced in rectangular sheet form, the waste and concomitant costs involved in cutting to conform these materials to circular configuration is a very serious deterrent to the use of circular electrodes.

Thus, it has remained a challenge in the chlor-alkali industry to design a cell with electrode frame construction that minimizes costs while providing adequate strength to support the pressures which must be applied to the individual electrode frames to sufficiently compress the gaskets between the membranes and adjacent electrodes to effect a liquid-tight seal, as well as being able to withstand the gas collection and pressure build-ups that normally occurs during operation within the individual electrodes. It has further been a problem to design individual electrode frames which employ means that serve to effectively restrain the gaskets during their compression and still provide accurate and uniform inter-electrode spacing.

The aforementioned problems are solved in the design of the apparatus comprising the present invention by providing in a filter press membrane electrolytic cell a reinforced electrode frame channel of sufficient strength to withstand the gasket compression pressure applied to the cell during assembly and which will concurrently serve as an effective gasket restraint during assembly and operation of the cell.

SUMMARY OF THE INVENTION

It is an object of the present invention to provide a novel frame for electrodes for use in monopolar filter press cells for the production of chlorine and caustic soda and oxychlorine compounds.

It is another object of the present invention to provide a channel or a U-shaped electrode frame component with an external strip that reinforces the channel or frame component against the gasket compression forces.

It is an additional object of the present invention to provide a novel electrode frame for use in monopolar filter press cells that combines with the gaskets to direct the cell compression forces along the reinforced portion of the frame.

It is a further object of the present invention to provide an electrode frame formed from relatively thin material that is of sufficient strength to be able to withstand the compression forces to which the assembled filter press membrane cell is subjected.

It is yet another object of the present invention to provide an improved electrode frame that facilitates the accurate and uniform inter-electrode spacing.

It is a feature of the present invention that an external metallic strip reinforces the channel or electrode frame component of each electrode frame to enable the individual frames to withstand the gasket compression forces to which they are subjected during cell assembly, as well as serving as a retainer for the gaskets.

It is another feature of the present invention that the external reinforcing strip serves as a means to ensure the accurate inter-electrode spacing of the electrode frames during assembly.

It is yet another feature of the present invention that the compression forces applied to the cell during assembly are distributed along the reinforced portion of the electrode frame.

It is an advantage that the improved electrode frame and gasket assembly of the present invention avoids unequal distribution of the compression forces among the sealing means when the filter press membrane electrolytic cell is assembled.

It is a further advantage of the present invention that the electrode frame channel or component may be formed from relatively thin sheets of material.

It is an additional advantage of the present invention that the improved electrode frame design permits the electrode surface material to be affixed to the frame so that it is flush with the outer surfaces of the frame and in a reinforcing manner that tends to provide additional structural support for the frames.

These and other objects, features and advantages are provided in a filter press membrane electrolytic cell having a reinforced electrode frame channel that is backed by a reinforcing element that also serves as a gasket restraint when the adjacent electrodes and gaskets are compressed to form an assembled cell.

BRIEF DESCRIPTION OF THE DRAWINGS

The advantages of this invention will become apparent upon consideration of the following detailed disclsoure of the invention, especially when it is taken in conjunction with the accompanying drawings wherein.

DETAILED DESCRIPTION OF THE PREFERRED EMBODIMENT

It is to be understood that the filter press membrane cell described in the instant disclosure includes a plurality of electrodes. The electrodes are anodes and cathodes arranged in alternating sequence as will be described in greater detail hereafter. The term "anode" or "cathode" is intended to describe the entire electrode unit which is comprised of a frame which encases the periphery of the appropriate electrode and on opposing sides has anodic or cathodic surfaces, as appropriate, attached thereto. The space within the individual electrode between the electrode surfaces comprises the major portion of the compartment through which the anolyte or catholyte fluid, as appropriate, passes during the electrolytic process. The particular electrode compartment is defined by the pair of membranes that are placed adjacent, but exteriorly of the opposing electrode surfaces, thereby including the opposing electrode surfaces within each compartment. The term "anode" or "cathode" is further intended to emcompass the electrical current conductor rods that pass the current through the appropriate electrode, as well as any other elements that comprise the entire electrode unit.

Figure 1:
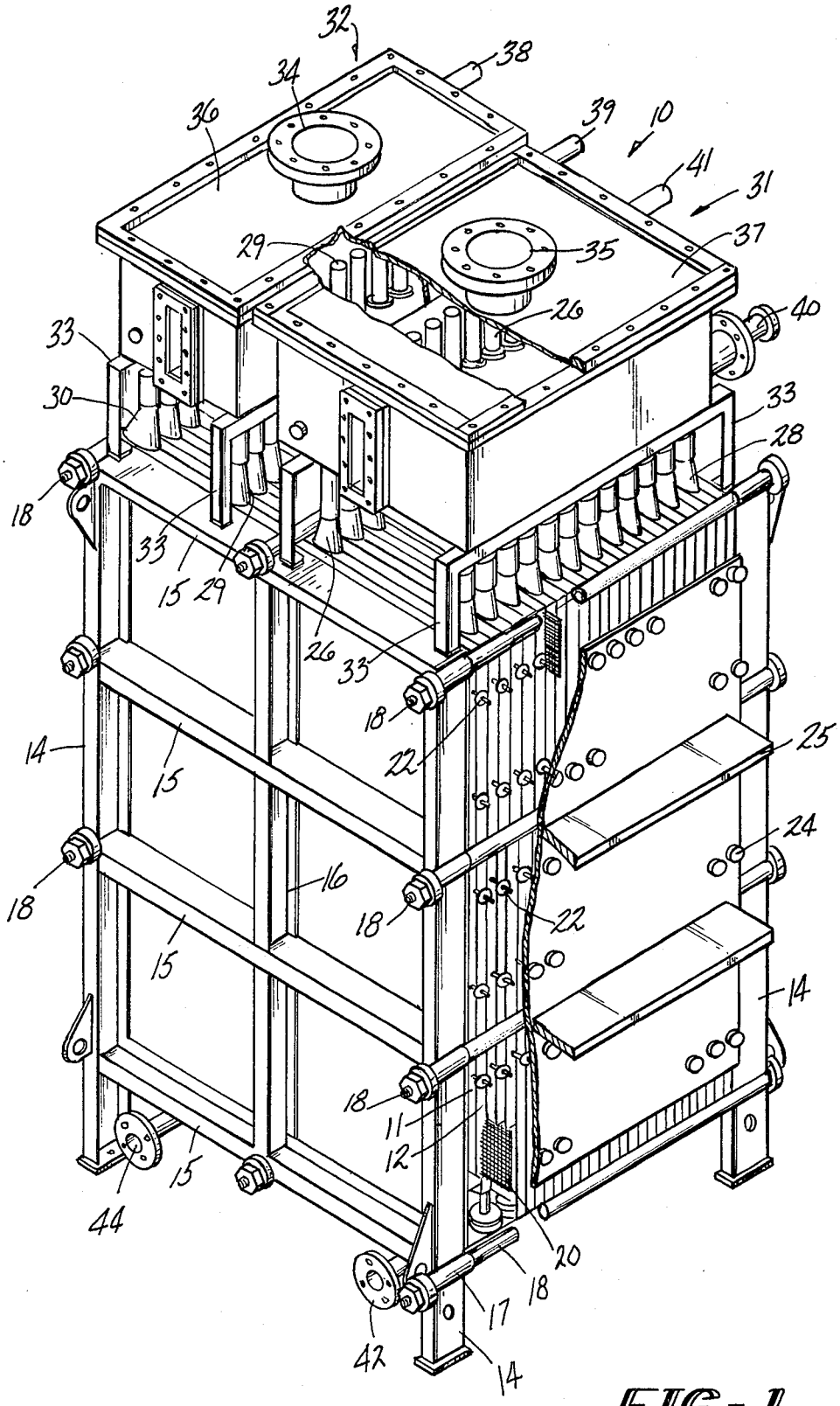
FIG. 1 is a side perspective view of a monopolar filter press membrane electrolytic cell with appropriate portions broken away to illustrate the anodes, cathodes, anolyte disengager, the catholyte disengager, and partially diagramatically showing the positioning of the ion-selectively permeable membranes between each pair of electrode frames.

Referring to FIG. 1, a filter press membrane cell, indicated generally by the numeral 10, is shown in a side perspective view. It can be seen that cathodes 11 and anodes 12 alternate and are oriented generally vertically. The cathodes 11 and anodes 12 are supported by vertical side frame members 14, horizontal side frame members 15, and intermediate vertical side frame members 16 (only one of which is shown). The cathodes 11 and anodes 12 are pressed together and secured by a series of tie bolts 18 which are inserted through apropriate mounting means affixed to the vertical side frame members 14 and horizontal side frame members 15. To prevent short circuiting between the electrodes during the electrolytic process, the tie bolts 18 have tie bolt insulators 17 through which the tie bolts 18 are passed in the area of the cathodes 11 and anodes 12.

Figure 2:
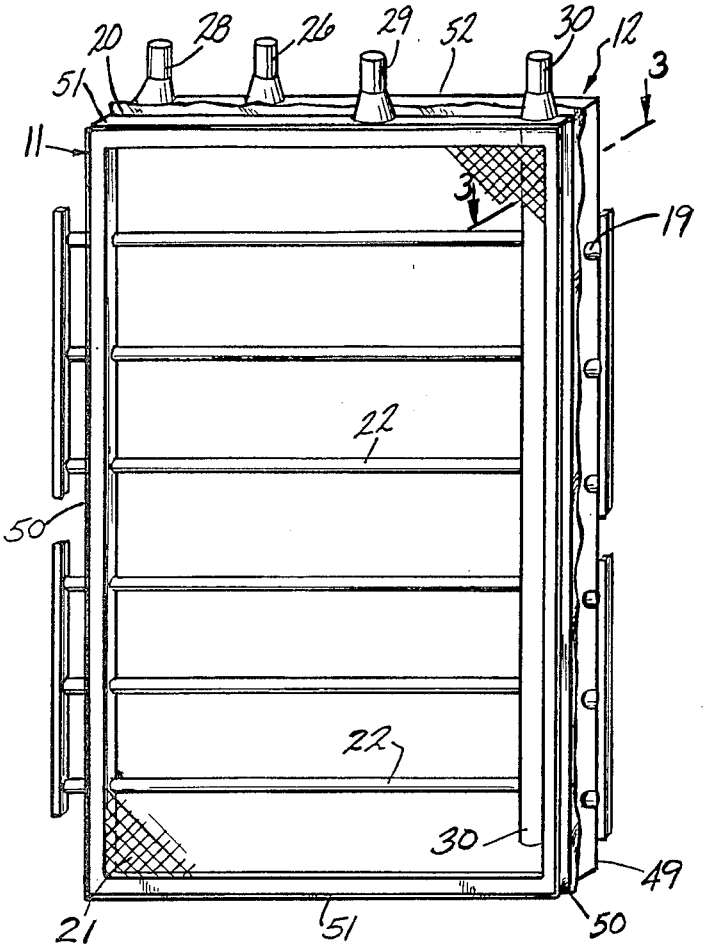
FIG. 2 illustrates a front elevational perspective view of a pair of adjacent electrode frames employing the reinforced electrode frames of the present invention.

Electrical current is passed, for example, from an external power source through the anode bus and then via anode bus nuts (both not shown) into the anode conductor rods 19 of FIG. 2. From that point, the anode conductor rods 19 carry the current into the opposing anodic surfaces 13, shown in FIGS. 3–6. The current continues flowing through the membrane 20, through the opposing cathodic surfaces 21, shown also in FIGS. 3–6, the cathode conductor rods 22 and the cathode bus nuts 24 to the cathode bus 25 where it continues its path out of the cell. The cathode bus nuts 24 are only partially shown in FIG. 1 since there is a corresponding cathode bus nut for each cathode 11 and cathode conductor rod 22. Ion-selective permeable membranes 20 are diagramatically shown in FIG. 1 to illustrate how each anode 12 and cathode 11 are separated by the membrane.

Projecting from the top of anodes 12 and cathodes 11 are a series of fluid flow conduits. FIGS. 1 and 2 show anode risers 26 and anode downcomers or anolyte return lines 28 projecting from the top of each anode frame 12. Similarly, cathode risers 29 and cathode downcomers or catholyte return lines 30 are shown projecting from the top of each cathode 11. The risers are generally utilized to carry the appropriate electrolyte fluid with the accompanying gas, either anolyte with chlorine gas or catholyte with hydrogen gas, to the appropriate disengager mounted atop the filter press membrane cell 10. The anolyte disengager is indicated generally by the numeral 31, while the catholyte disengager is indicated generally by the numeral 32. Each disengager is supported atop of the cell 10 by disengager supports 33, seen in FIG. 1. It is in each of these disengagers that the entrained gas is enabled to separate from the liquid of the anolyte or catholyte fluid, as appropriate, and is released from the appropriate disengager via either a cathode gas release pipe 34 or an anode gas release pipe 35 affixed to the appropriate catholyte disengager cover 36 or anolyte disengager cover 37.

Also partially illustrated in FIG. 1 is the catholyte replenisher conduit 38 which carries deionized water into the catholyte disengager 32. The deionized water is appropriately fed through the catholyte disengager 32 to each cathode 11 in cell 10. A catholyte outlet pipe 39 is also partially illustrated and serves to control the level of liquid in the catholyte fluid in the catholyte disengager 32 by removing caustic to its appropriate processing appratus.

An anolyte replenisher conduit 40 carries fresh brine into the anolyte disengager 31 and is best seen in FIG. 1. The fresh brine is then appropriately fed into each anode 12 where it is mixed with the existing anolyte fluid which is recirculated from the anolyte disengager 31 into each anode 12 via the downcomers 28. An anolyte outlet pipe 41 is also shown and serves to control the level of liquid in the anolyte fluid within the anolyte disengager 31 by removing the spent brine from the anolyte disengager 31 for regeneration.

Also shown in FIG. 1 are a cathodic bottom manifold 42 and an anodic bottom manifold 44, which are utilized to drain the apropriate electrodes.

The filter press membrane cell 10 has been described only generally since the structure and the function of its central components are well known to one of skill in the art.

FIG. 2 shows that the cathodes 11 and anodes 12 comprise anode vertical frame members 49, only one of which is shown, and cathode vertical frame members 50. Interconnecting the cathode vertical frame members 50 are the generally horizontal cathode frame members 51. Similarly, interconnecting the anode vertical frame members 49 are anode generally horizontal frame members 52, only one of which is shown. When assembled the appropriate cathode and anode frame members comprise cathode frame 56 and anode frame 59, each of which have generally planar opposing first and second surfaces.

The opposing cathodic surfaces 21, one of which is partially shown in FIG. 2 and which are further partially illustrated in FIGS. 3–6, are foraminous and positioned generally vertically in the assembled filter press membrane cell 10. The foraminous cathodic surfaces 21 are appropriately fastened to cathode vertical frame members 50 and generally horizontal frame members 51, such as by welding. Electrical current is conducted between the opposing cathodic surfaces 21 and the cathode conductor rods 22 by appropriate connectors (not shown). This space between the opposing cathode surfaces 21 comprises the major portion of the catholyte compartment through which the conductor rods 22 pass and within which the catholyte fluid is found. The catholyte compartment is defined by the pair of membranes that are placed adjacent but exteriorly of the opposing cathodic surfaces 21. The catholyte fluid is retained within the catholyte compartment by the hydraulic impermeability of the membranes 20 which are placed adjacent each opposing cathodic surface 21 in the assembled cell.

It is to be understood that each anode has a pair of opposing anodic surfaces 13 which are also foraminous and are seen in partial illustration in FIGS. 3–6. An anolyte compartment is formed between each pair of membranes 20 and includes therewithin the opposing anodic surfaces 13 in the assembled cell 10. Similarly, the anolyte fluid is found within the anolyte compartment and is retained there by the hydraulic impermeability of the membranes 20. The anolyte compartments also have anode conductor rods 19 which extend within the compartments and are connected directly to the opposing anodic surfaces 13 by connectors (not shown) to pass electric current directly between the anodic surfaces 13 and the conductor rods 19.

Figure 3:
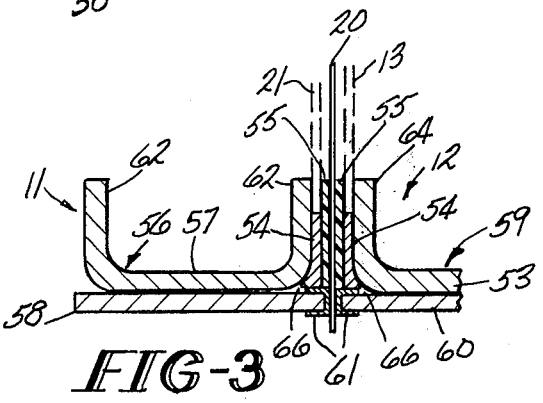
FIG. 3 is an enlarged partial sectional view of the electrode frames of FIG. 2 taken along the line 3—3 showing a preferred embodiment of the reinforced electrode frame channels in cooperative association with the gaskets and membrane as they appear in an assembled filter press membrane cell.

FIG. 3 shows the cooperation between the cathodes 11, the anodes 12, the sealing means or gaskets 54, and the opposing surfaces of the separator or membrane 20 between each adjacent anode 12 and cathode 11 in an assembled cell 10. FIG. 3 also shows a pair of thin non-conductive strips 55 which are utilized to prevent the membrane from tearing during compression of the electrode frames in the cell as a result of gasket deformation. These non-conductive strips 55 are placed between the membrane 20 and each gasket 54 and are normally made from polytetrafluoroethylene, sold commercially as Teflon ®.

FIG. 3 also shows in detail the components which comprise the cathode frame 56 that is formed from the aforementioned cathode vertical and horizontal frame members 50 and 51, respectively. Cathode frame 56 can be viewed as being C-shaped or U-shaped with a base portion 57 that has a reinforcing strip 58 welded to it. Also partially shown in detail in FIG. 3 are the components of the anode frame 59 that is formed from the aforementioned anode vertical and horizontal frame memberss 49 and 52, respectively. Anode frame 59 is also C-shaped or U-shaped with a base portion 53 that has a reinforcing strip 60 appropriately attached thereto, such as by welding. Non-conductive U-shaped spacers 61, typically made from polypropylene, may be placed about the ends of reinforcing strips 58 and 60 to help provide the proper inter-electrode spacing between the electrodes and to prevent the membrane 20 from being damaged. It should be noted that cathode frames 56 and anode frames 59 are of the same construction about their entire peripheries as disclosed herein for their vertical frame members.

As can be seen in FIG. 3, the curvature of the cathode frame 56 and the anode frame 59 form opposing pairs of cathode legs 62 and anode legs 64, respectively. At the point of curvature of the appropriate electrode frame legs between the cathode frame 56, the anode frame 59 and each adjacent gasket 54, it can be seen that there is a void 66 into which the gaskets 54 may deform during assembly in response to the compressive forces exerted during assembly of the cell.

Due to the placement of the gasket 54 and the reinforcing strips 58 and 60, when the cell 10 is subjected to the compressive forces during assembly, the pressure is directed through the portions of the cathode frame 56 and the anode frame 59 which abut the cathode reinforcing strip 58 and the anode reinforcing strip 60, respectively. This effectively prevents excessive pressure from being exerted against the cathode frame legs 62 and the anode frame legs 64 and thus, helps to prevent any buckling or bending of those members.

Figure 4:
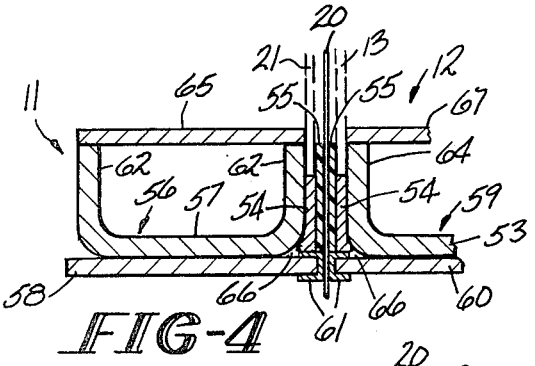
FIG. 4 depicts an enlarged partial sectional view of an alternative embodiment of the reinforced electrode frame channels in cooperative association with the gaskets and membrane as they appear in an assembled filter press membrane cell.

FIG. 4 shows an alternative embodiment of the reinforced electrode frames which is identical to that described in FIG. 3 with the exception that a reinforcing bar is periodically spaced along the length of the appropriate frame between the opposing legs to provide additional strength if needed. As seen in FIG. 4, a cathode reinforcing bar 65, typically between $\frac{1}{8}''$ to $\frac{1}{4}''$ in diameter, is shown appropriately fastened, such as by spot welding, to the opposing cathode legs 62. Similarly, anode frame reinforcing rods 67 may be appropriately fastened to the anode legs 64, only one of which is shown, of the anode frame 59. Cathode frame reinforcing rods 65 and anode frame reinforcing rods 67 may be positioned as far apart as needed to provide reinforcement along the length of their respective electrode frames.

Figure 5:
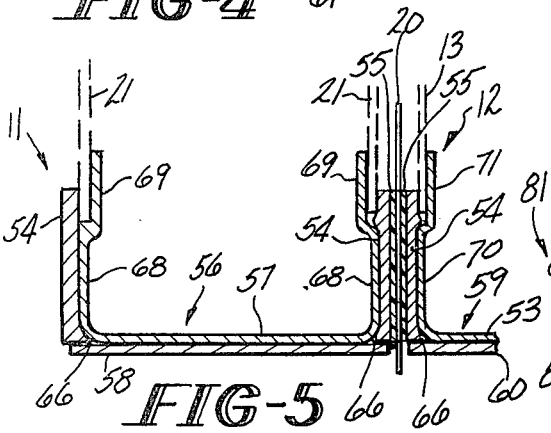
FIG. 5 illustrates an enlarged partial sectional view of an additional embodiment of the reinforced electrode frame channels in cooperative association with the gaskets and membrane as they appear in an assembled filter press membrane cell.

FIG. 5 shows an additional embodiment of the reinforced electrode frames. The cathode 11 is shown having a cathode frame 56 with cathode frame legs 68 that are formed to receive the opposing cathodic surfaces 21 so that the opposing cathodic surfaces 21 are flush with the exterior portion of the cathode frame legs 68. Each of the cathode frame legs 68 is formed so that there is an indented portion 69 into which the opposing cathodic surfaces 21 are placed. A cathode reinforcing strip 58 is shown appropriately fastened, such as by welding, to the base portion 57 of the cathode frame 56 connecting the opposing cathode frame legs 68. Void 66 appears at the bend in each cathode frame 56 where the opposing cathode frame legs 68 are formed to provide a place into which the gasket 54 may deform in response to the compressive forces exerted during assembly.

The anode frame 59 of FIG. 5 similarly has a pair of opposing anode frame legs 70, only one of which is shown. Anode frame legs 70 are formed so that there is an indented portion 71 similar to the indented portion 69 of the cathode frame legs 68. Opposing anodic surfaces 13, only one of which is shown, are appropriately fastened, such as by welding to the indented portion 71 of each anode frame leg 70. An anode reinforcing strip 60 is partially shown appropriately fastened, such as by welding, to the base portion 53 of the anode frame 59. A void 66 appears at the bend in each anode frame 59 where the opposing anode frame legs 70 are formed to provide a place into which the gasket 54 may deform in response to the compressive forces exerted on the cell 10 and the electrode frames during assembly. The assembled cell 10 has alternating anodes 12 and cathodes 11 with the individual anode frames 59 and cathode frames 56 separated by two gaskets 54 and two non-conductive strips 55; each pair of gaskets 54 and non-conductive strips 55 being separated by the membrane 20 in the manner shown.

The reinforced electrode frames shown in FIGS. 3, 4, and 5 all have the reinforcing strips 58 and 60 serving a secondary function of retaining the gaskets 54. The cathode reinforcing strips 58 and the anode reinforcing strips 60 prevent the gaskets 54 from slipping or popping out from between the compressed electrode frames by extending beyond the edge of the cathode frame legs 62 and the anode frame legs 64. Additionally, the voids 66 into which the gaskets 54 are allowed to deform under the compressive forces of assembly also help to prevent the gaskets from slipping during assembly and during the operation of the filter press membrane cell 10.

Figure 6:
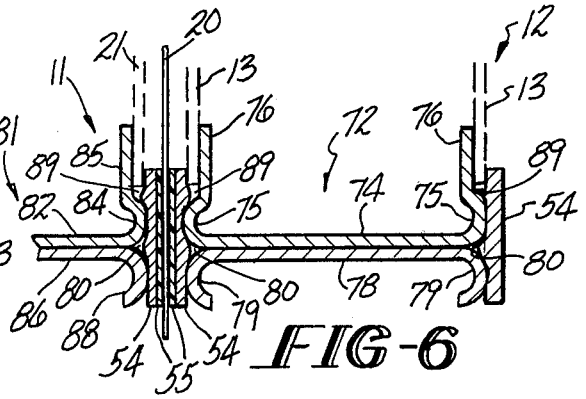
FIG. 6 shows an enlarged partial sectional view of a further embodiment of the reinforced electrode frame channels in cooperative association with the gaskets and membrane as they appear in an assembled filter press membrane cell.

A further embodiment of the reinforced electrode frames is shown partially in FIG. 6. The anode 12 is shown having an anode frame indicated generally by the numeral 72 which comprises a base portion 74 and two opposing anode frame legs 75. Anode frame leg portions 74 are formed so that there is an indented portion 76 into which the anodic surfaces 13 may be placed and appropriately fastened, such as by welding. An anode frame reinforcing strip 78 is appropriately fastened, such as by welding, to the exterior side of the anode frame base 74. The anode frame reinforcing strip 78 has curved or arcuate legs 79 on opposing sides to reduce the hazard of cutting or tearing the membrane on a sharp edge and to provide a stronger and better reinforced frame portion to bear the compressive forces to which the frames will be subjected during assembly and operation. The curvatures of the arcuate anode legs portion 79 and the anode frame leg portions 75 provide a void 80 into which the gaskets 54 may be formed during assembly. This void 80 serves the same purpose as the aforementioned void 66 described in connection with the other frame embodiments previously disclosed.

Cathode frame 81 is partially shown in FIG. 6. Cathode frame 81 is constructed similarly to the anode frame 72 and has a frame base portion 82 with cathode frame leg portions 84, only one of which is shown. Cathode frame leg portion 84 has an indented portion 85 into which the cathodic surface 21 is securely fastened, such as by welding. The cathode frame 81 has a cathode frame reinforcing strip 86 which is appropriately fastened, such as by welding to the exterior side of the cathode frame base portion 82. At the point of curvature of the cathode frame leg portions 84 and the cathode arcuate reinforcing strip leg portions 88, a void 80 is formed into which gaskets 54 may deform in response to the compressive forces exerted during assembly of cell 10. An additional void 89 is shown in the embodiment in FIG. 6 between the appropriate electrode surface and electrode leg portions where the electrode frame leg indented portion begins. This void 89 also permits the gaskets 54 to deform thereinto during assembly. Voids 89, in conjunction with voids 80, serve to hold the gaskets 54 in place and prevent them from popping out during assembly of cell 10. In the embodiment shown in FIG. 6, the anode frame 72 is assembled with a gasket 54 and a thin non-conductive strip 55 between it and the membrane 20. In a similar fashion, the cathode frame 81 is assembled with the gasket 54 and the thin non-conductive strip 55 between it and the membrane 20. Individual electrode frames are added to the cell 10 during assembly in a like manner until the desired number are obtained. The cell 10 is then compressed and secured in its compressed state by tightening the tie bolts 18 of FIG. 1.

It should be noted that in the embodiments shown in FIGS. 3–5, the cathode reinforcing strips 58 are of a width that is greater than the width of the cathode base portion 57 and the cathode legs 62, or cathode legs 68 in FIG. 5. Similarly, the anode reinforcing strips 60 extend in width beyond the combined width of the anode base portion 53 and the anode legs 64 or anode legs 70 of FIG. 5. This greater width allows the reinforcing strips to retain the gaskets 54, as previously described.

The cathode frames 56 are made from material, such as nickel, that promote the direct resistance welding of the cathodic surfaces 21 to the cathode frame 56. Alternately, iron, steel, stainless steel, or various alloys of these and other metals may be employed in the construction of the cathode frames 56. The anode frame 59 is typically made from a corrosion resistant material, such as titanium, which also permits the opposing anodic surfaces 13 to be directly welded to the anode frame 59.

The opposing electrode surfaces are preferably made of metal of the same type as the electrode frames. The opposing cathodic surfaces 21 are preferably made of nickel, while the opposing anodic surfaces 13 are preferably made of titanium coated with an activating material. The opposing electrode surfaces must have good low overvoltage properties, adequate conductivity, good corrosion resistance, and sufficient tensile strength for the designed operating pressure of the cell 10.

The electrode frames are subjected to hydrostatic force during the operation of the cell 10 that is exerted by the internal pressure of the cell outwardly against the electrode frames. This hydrostatic force is the product of the operating pressure at the particular point, the height of the electrode frames and the thickness of the particular electrode frames. The resisting force that the electrode surfaces, either the opposing anodic surfaces 13 or the opposing cathodic surfaces 12, exert in response to the outward hydrostatic pressure is limited to the allowable tensile strength for the material and structure employed in making those surfaces. The term "tensile strength" as used herein is a measure of maximum resistance to deformation.

The electrode frames, either the cathode frames 56 or the anode frames 59, are made of material of a particular thickness that is calculated for the specific design and pressure to which they will be subjected. The tensile strength of the individual frames must be equal to or greater than the tensile strength of the opposing anodic surfaces 13 or the opposing cathodic surfaces 21, as appropriate. The tensile strength of the electrode frames is required to resist bending under the compressive forces exerted to compress the gaskets 54 during cell assembly, rather than to the internal hydraulic pressures generated during the operation of the cell.

The membranes 20 utilized in the cell 10 of the present invention are inert and flexible having ion exchange properties. The membranes are relatively impervious to the hydrodynamic flow of the electrolyte and the passage of gas products produced in the cell. The membranes 20 are typically composed of fluorocarbon polymers having a plurality of pendant sulfonic acid groups or carboxylic acid groups or mixtures of sulfonic acid groups and carboxylic acid groups. A perfluorosulfonic acid resin membrane suitable for use in the cell 10 of the instant invention is marketed commercially by E. I. Du Pont de Nemours and Company under the trademark "Nafion®". An alternate type of membrane 20 suitable for use in the cell 10 of the present invention is a carboxylic acid type cation exchange membrane available commercially from the Asahi Glass Company under the trademark "Flemion®".

In operation the filter press membrane cell 10 is assembled by first placing a cathode 11 in a suitable position, such as horizontally, to receive thereon the gasket 54 about the entire periphery of the cathode frame 56. A non-conductive strip 55 then is placed atop of the gasket 54 so that it is partially supported by the gasket 54 and the cathodic surface 21. A suitable membrane 20 is then stretched across the top of the cathode 11 and another non-conductive strip 55 is placed atop of membrane 20. A second gasket 54 is placed against the non-conductive strip 55 and the anode frame 12 is placed thereagainst. This procedure is repeated a predetermined number of times until the cell 10 is assembled with a predetermined number of cathodes 11 and anodes 12. The cell 10 has end cathodes 11 on each end. Compressive forces are then applied to the cell 10 to compress the individual electrode frames in the gaskets 54 together to effect a fluid-tight seal between the electrode frames. When the proper inter-electrode spacing is obtained and the proper level of compression has been applied, the cathode frames 56 and anode frames 59 are secured in their positions by the tie bolts 18. The thus assembled electrodes are then raised to an upright position and connected to the disengagers and appropriate fluid flow lines. The reinforcing strips 66 serve to impart additional strength to the individual electrode frames to prevent buckling under the compressive forces that are exerted during cell assembly and which are retained during cell operation. Additionally, the reinforcing strips serve to retain the gaskets 54 to prevent them from slipping or popping out from between the individual electrode frames.

While the preferred structure in which the principles of the present invention have been incorporated are shown and described above, it is to be understood that the invention is not to be limited to the particular details thus presented, but in fact, widely different means may be employed in the practice of the broader aspects of this invention. The scope of the appended claims is intended to encompass all obvious changes in the details, materials, and arrangement of parts which will occur to one of skill in the art upon a reading of the disclosure.

What is claimed is:

1. In a frame for an electrode utilized in a filter press membrane cell and adapted to have opposing electrode surfaces connected thereto and which are adjacent membranes in an assembled filter press membrane cell comprising:

a. a base portion of predetermined thickness and predetermined length having a first side and a second side;

b. a first leg connected to the first side of the base portion and adapted to have foraminous electrode surface means fixedly fastened thereto;

c. a second leg connected to the second side of the base portion, the second leg combining with the base portion and the first leg to be of an assembled predetermined width and adapted to have foraminous electrode surface means fixedly fastened thereto; and d. reinforcing means fixedly fastened to the base portion to strengthen the frame against compressive force applied against the first and second legs adjacent the base portion and being of a second width greater than the assembled predetermined width.

2. The apparatus according to claim 1 wherein the first leg and the second leg are connected by at least one reinforcing rod means.

3. The apparatus according to claim 1 wherein the first leg and the second leg are further at least partially indented to form electrode surface-receiving areas to which the electrode surface means are fastened.

4. In an electrode for use in a filter press membrane cell designed to be compressively assembled with a predetermined number of electrodes separated by gasket means and membrane means comprising:

(a) electrode frame means of predetermined thickness having a base portion connecting two opposing leg portions, each leg portion having a gasket receiving surface against which the gasket means is placed during cell assembly;

(b) first electrode surface means fixedly fastened to one of the two opposing leg portions;

(c) second electrode surface means fixedly fastened to the second of the two opposing leg portions; and (d) reinforcing means fixedly fastened to the base portion and forming a void with the base portion into which the gasket means may deform during cell assembly.

5. The apparatus according to claim 4 wherein the first electrode surface means is adjacent the gasket receiving surface of the one of the two opposing leg portions.

6. The apparatus according to claim 5 wherein the second electrode surface is adjacent the gasket receiving surface of the second to the two opposing leg portions.

7. The apparatus according to claim 6 wherein the electrode further comprises a plurality of conductor rods connectable to an electrical power source, each conductor rod passing through the reinforcing means and the base portion.

8. The apparatus according to claim 7 wherein the two opposing leg portions are connected by at least one reinforcing rod means.

9. The apparatus according to claim 7 wherein each of the two opposing leg portions are indented to form an electrode surface-receiving area.

10. The apparatus according to claim 7 wherein the electrode is further an anode.

11. The apparatus according to claim 7 wherein the electrode is further a cathode.

12. In an electrode having a frame, the electrode being utilized in a filter press membrane cell comprising:

(a) a base portion of predetermined thickness and predetermined length having a first side and a second side;

(b) a first leg connected to the first side of the base portion;

(c) a second leg connected to the second side of the base portion, the second leg combining with the base portion and the first leg to be of an assembled predetermined width;

(d) reinforcing means fixedly fastened to the base portion to strengthen the frame and being of a second width greater than the assembled predetermined width; and (e) foraminous electrode surface means fixedly fastened to the first leg and the second leg.

13. The apparatus according to claim 12 wherein the first leg and the second leg are connected by at least one reinforcing rod means.

14. In an electrode having a frame, the electrode being utilized in a filter press membrane cell comprising:

(a) a base portion of predetermined thickness and predetermined length having a first side and a second side;

(b) a first leg connected to the first side of the base portion, the first leg being at least partially indented to form an electrode surface-receiving area;

(c) a second leg connected to the second side of the base portion and being at least partially indented to form an electrode surface-receiving area, the second leg combining with the base portion and the first leg to be of an assembled predetermined width;

(d) reinforcing means fixedly fastened to the base portion to strengthen the frame and being of a second width greater than the assembled predetermined width; and (e) foraminous electrode surface means fixedly fastened to the at least partially indented electrode surface-receiving area of the first leg and the second leg.

15. The apparatus according to claim 14 wherein the first leg and the second leg are connected by at least one reinforcing rod means.

16. A filter press membrane electrolytic cell with anolyte and catholyte infeed and outlet lines, product outlet lines, and anolyte and catholyte gas-liquid disengagers, comprising:

(a) a plurality of cathodes, each cathode having a frame with at least a base portion and first and second leg portions attached to opposing ends of the base portion;

(b) a plurality of anodes, each anode being positioned between a pair of cathodes and having a frame with at least a base portion and first and second leg portions attached to opposing ends of the base portion;

(c) a plurality of ion-selective membranes, each membrane being interpositioned between an adjacent anode and cathode;

(d) sealing means positioned between each cathode, interpositioned membrane and anode;

(e) reinforcing means attached to the base portion of each anode frame and cathode frame to reinforce each anode frame and cathode frame against the compressive forces that are exerted during assembly and operation of the cell; and (f) compression applying and retaining means to compress and secure the cell in an assembled state directing the compression forces along the reinforcing means.

17. The apparatus according to claim 16 wherein the sealing means further comprise gaskets.

18. The apparatus according to claim 16 wherein the compression applying and retaining means are a plurality of tie bolts.

* * * * *